US006091013A

United States Patent [19]

Waller, Jr. et al.

[11] Patent Number: 6,091,013

[45] Date of Patent: Jul. 18, 2000

[54] ATTACK TRANSIENT DETECTION FOR A MUSICAL INSTRUMENT SIGNAL

[76] Inventors: James K. Waller, Jr., 9901 Allen Rd., Clarkston, Mich. 48348; Russell W. Blum, 49525 Callens, New Baltimore, Mich. 48047

[21] Appl. No.: 09/217,548

[22] Filed: Dec. 21, 1998

Related U.S. Application Data

[60] Provisional application No. 60/068,502, Dec. 22, 1997.

[51] Int. Cl.[7] ..... G10H 1/057

[52] U.S. Cl. ..... 84/663

[58] Field of Search ..... 84/627, 663, 702, 84/703, 738, DIG. 12

[56] References Cited

U.S. PATENT DOCUMENTS

| | | | |
|---|---|---|---|
| 4,781,097 | 11/1988 | Uchiyama et al. | 84/738 |
| 4,911,053 | 3/1990 | Kashio et al. . | |
| 5,633,473 | 5/1997 | Mori et al. | 84/738 X |
| 5,648,626 | 7/1997 | Okamoto . | |
| 5,710,387 | 1/1998 | Szalay | 84/663 |

*Primary Examiner*—Stanley J. Witkowski

[57] ABSTRACT

An attack transient detector determines the moment of note onset; e.g. the time at which a guitar string is plucked; from a signal generated by a musical instrument. Detection of the attack transient causes the generation of a trigger signal which can be used to control processing of the musical instrument signal.

18 Claims, 6 Drawing Sheets

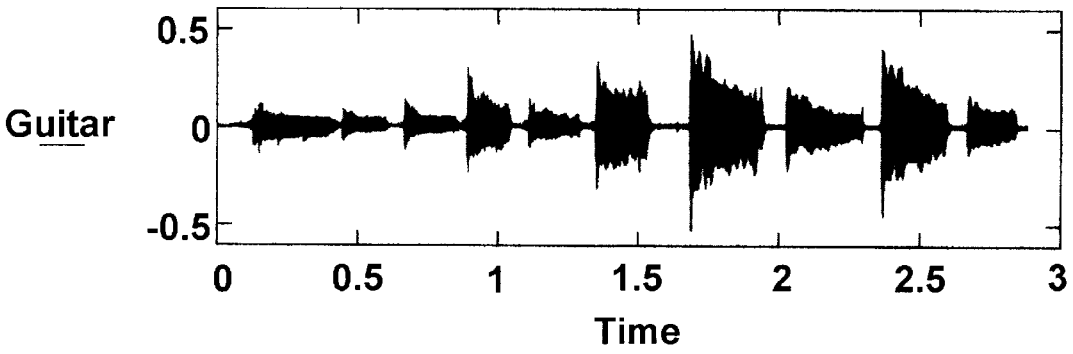
Figure 3a - Guitar Signal of 10 Plucked Notes
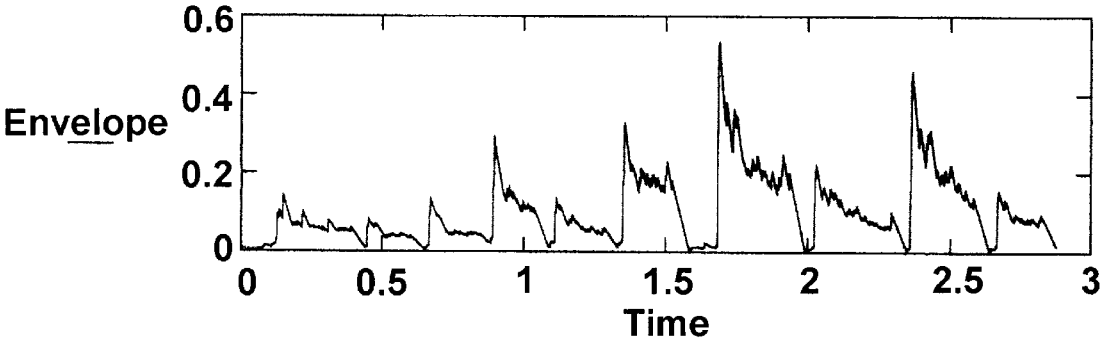
Figure 3b - Envelope of Guitar Signal

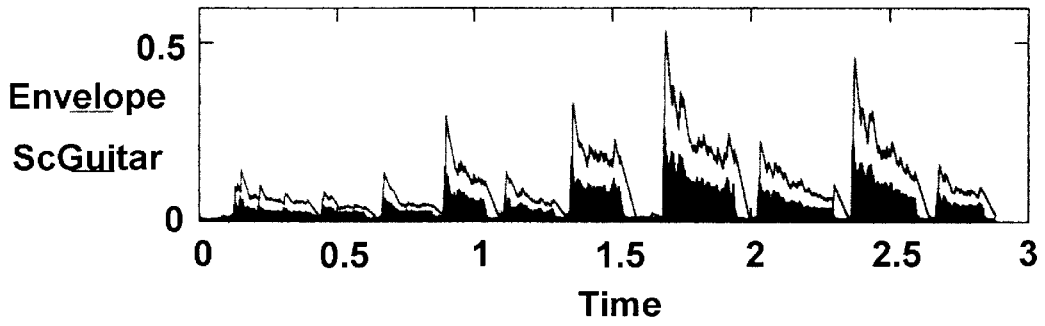
FIGURE 3c - Delayed Amplitude Envelope and Scaled Absolute Value of Guitar Signal
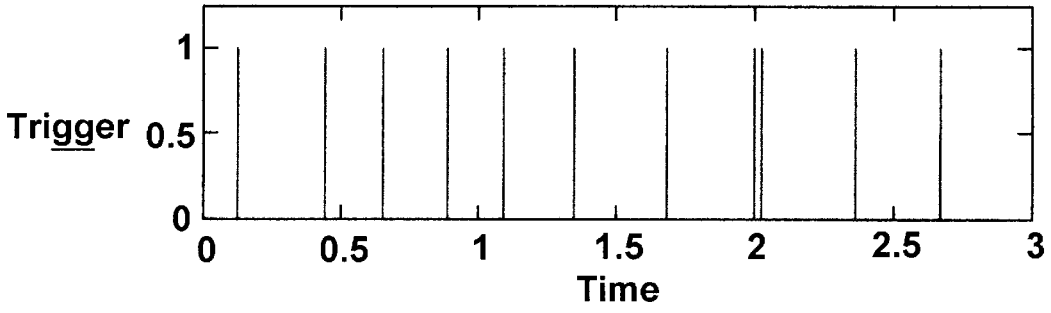
FIGURE 3d - Trigger Signal for Delayed Envelope and Scaled Guitar Signal
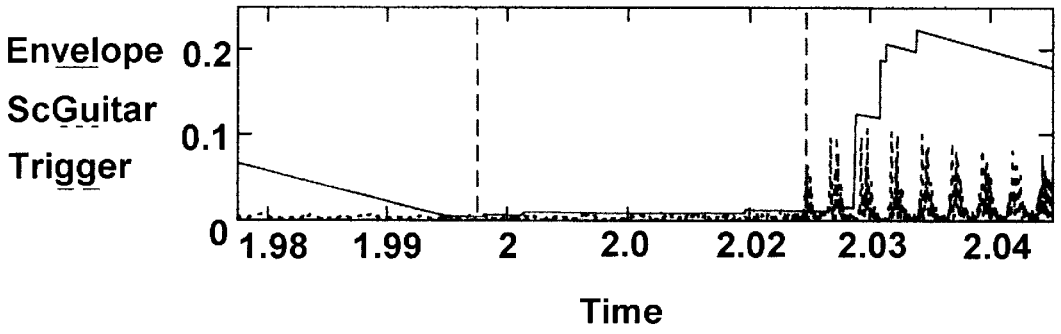
FIGURE 3e - Delayed Amplitude Envelope, Scaled Absolute Value of Guitar Signal, and Trigger Signal

ATTACK TRANSIENT DETECTION FOR A MUSICAL INSTRUMENT SIGNAL

This application claims benefit of Provisional Application 60/068,502 filed Dec. 22, 1997.

BACKGROUND OF THE INVENTION

The present invention relates to a method and system for generating a trigger signal in response to the detection of an attack transient; e.g. the moment of string release for a plucked string on an acoustic car electric guitar; in a signal generated by a musical instrument. The trigger signal can then be used to control processing of the signal from the musical instrument.

Prior systems have generated such trigger signals in one of two ways. In the first type of prior system a predetermined threshold level is used to define when the trigger signal is generated. The level of the musical instrument signal must increase to a level that is greater than the threshold level in order for the trigger to be generated and the trigger signal cannot occur again until the signal level from the musical instrument has decreased below the threshold level; thereby requiring musicians to carefully monitor their playing style in order generate a trigger for each note. The second type of prior system uses specialized equipment, such as that disclosed in U.S. Pat. No. 4,911,053, to generate the trigger signal, which requires the musician to purchase additional, often expensive, equipment.

SUMMARY OF THE INVENTION

In accordance with the present invention a system and method for detecting an attack transient in a signal from a musical instrument and for generating a trigger signal for controlling processing of the musical instrument signal are provided which, in a preferred embodiment, results in a trigger signal being generated for each plucked note played by the musician without the need for specialized equipment or monitoring of the signal level by the musician.

BRIEF DESCRIPTION OF THE DRAWINGS

Other objects and advantages of the invention will become apparent upon reading the following detailed description and upon reference to the drawings in which:

FIGS. 3*a*–3*e* show graphs of various signals used in the attack transient detector of FIGS. 1, 2, 5, 6 and 7;

While the invention will be described in connection with a preferred embodiment, it will be understood that it is not intended to limit the invention to that embodiment. On the contrary, it is intended to cover all alternatives, modifications and equivalents as may be included within the spirit and scope of the, invention as defined by the appended claims.

DETAILED DESCRIPTION OF THE INVENTION

Figure 1:
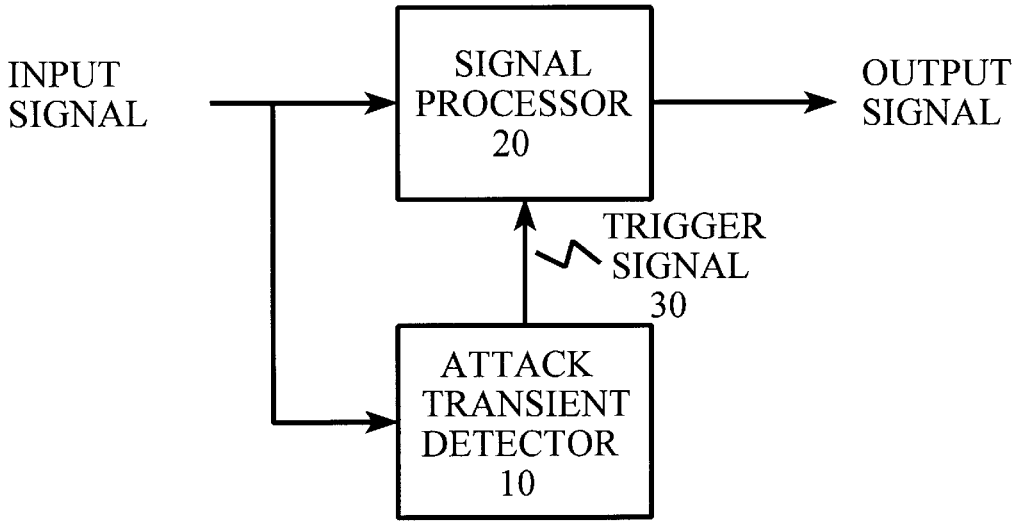
FIG. 1 is a block diagram of a first embodiment of the present invention wherein the attack transient detector provides a controlling trigger signal to a signal processor.

A first embodiment of the present invention will be described with reference to FIG. 1 which shows attack transient detector 10 in combination with signal processor 20. In this first embodiment a signal generated from the playing of a musical instrument; e.g. an electric guitar; is received by both attack transient detector 10 and signal processor 20. As discussed in more detail below, attack transient detector 10 monitors the incoming signal from the musical instrument and generates a trigger signal 30 for controlling the operation of signal processor 20, thereby providing the musician with automatic dynamic control of various aspects, such as signal level or effects parameters, of the operation of signal processor 20.

Figure 2:
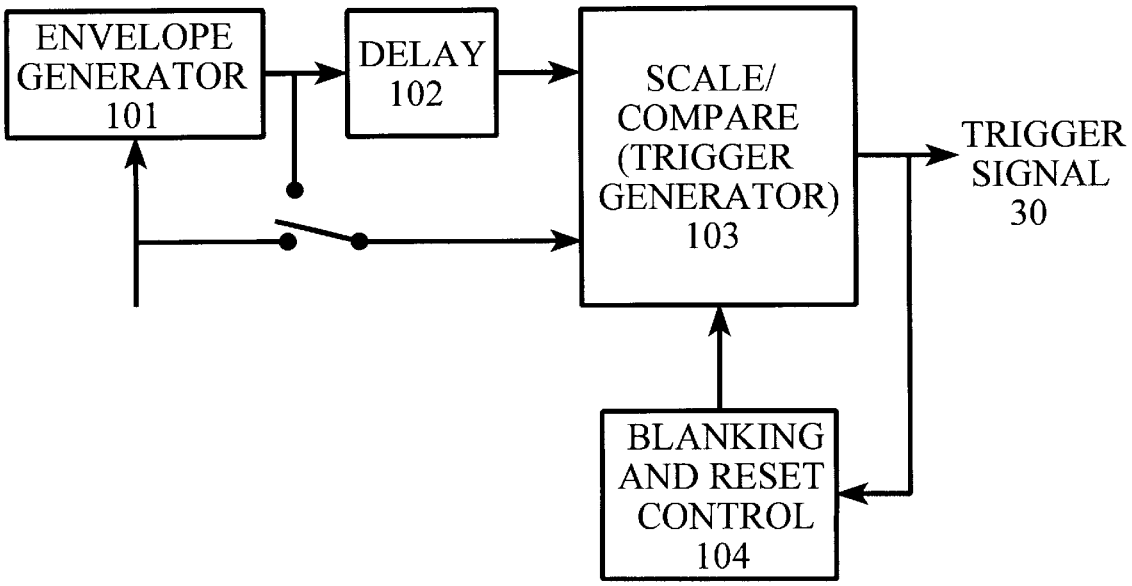
FIG. 2 is a more detailed block diagram of the attack transient detector of FIG. 1.

Turning to FIG. 2 a detailed block diagram of attack transient detector 10 is shown. Within detector 10 the incoming signal from the musical instrument is split into two paths, the first of which connects the signal directly to scaler and comparator block 103. The second path routes the signal through envelope generator 101 and delay block 102 before reaching the scaler and comparator block 103. Operation of the component blocks of attack transient detector 10 will now be described with reference to FIGS. 3*a*–3*d*. FIG. 3*a* shows an example of an incoming signal from a musical instrument. In this case the signal is from an electric guitar and consists of 10 plucked notes. Envelope generator 101 receives the incoming signal of FIG. 3*a* and outputs a signal which follows the magnitude of the amplitude envelope of the incoming signal, as shown in FIG. 3*b*. In the preferred embodiment of the present invention generator 101 is a peak follower with fast decay which outputs a signal following the amplitude envelope of the absolute value of the incoming signal. Those of ordinary skill in the art will appreciate that generator 101 could also be made to follow the amplitude envelope of only the maximum or minimum peaks of the incoming signal. The output of generator 101 is then input to delay block 102 so that the envelope signal is delayed with respect to the incoming signal, resulting in changes in the incoming signal leading the corresponding changes in the envelope, as shown in FIGS. 3*c* and 3*e*. Scaler and comparator block 103 receives the incoming signal from the musical instrument and the delayed envelope signal and performs the following operations:

1. the absolute value of the incoming signal is found to provide a first comparison value,
2. the value of the envelope signal is scaled by a predetermined constant to provide a second comparison value as a threshold, and
3. the first and second comparison values are compared and trigger signal 30 is generated when the first comparison value is greater than the second comparison value.

Those of ordinary skill in the art will recognize that, equivalently, the incoming musical instrument signal could be scaled and compared to the unscaled delayed envelope value and/or the output of envelope generator 101 could be used as the input to scaler and comparator 103 in place of the musical instrument signal to achieve the same triggering result. Once trigger signal 30 has been generated it is sent out to signal processor 20 and fed back to blanking and reset control block 104 which acts to disable the regeneration of trigger signal 30 until after a predetermined blanking period has passed, this preventing the occurrence of multiple trigger signals for a single attack transient, and to reset the output of scaler and comparator 103 to prepare for the next trigger signal occurrence. FIG. 3*d* shows the timing of the resulting trigger signals generated by the attack transient detector 10 for the incoming signal shown in FIG. 3*a*.

Determination of the values used for the amount of delay applied to the envelope signal by delay 102, the scaling constant used in scaler and comparator 103, and the length of the blanking period instituted by blank/reset unit 104 are dependent on the dynamics of the incoming musical instrument signal. Signals with fast attack times, such as those from plucked or hammered instruments like the guitar, piano or percussion instruments, require less delay for the envelope signal relative to signals with slower attack times, such as those from bowed instruments like the violin. The scaling constant for a given delay value is adjusted to minimize the generation of false trigger signals due to variations in the envelope signal while providing 100% detection of attack transients. Finally, the blanking time period is set to a value which allows the level of the delayed envelope signal to 'catch up' with that of the incoming signal thereby avoiding the occurrence of triggering multiple times for a single detected attack transient. In the exemplary embodiment where the incoming signal is generated by an electric guitar the length of delay is set at 4 milliseconds, the scaling constant equals 2; i.e. either the envelope value is multiplied by 2 or the incoming signal is divided by 2 before being compared; and the blanking interval is set to 20 milliseconds. Those of ordinary skill in the art will readily be able to determine appropriate values for delay, scaling and blanking from an analysis of the dynamics of whatever musical instrument signal is to be input to the present attack transient detector 10.

Figure 4:
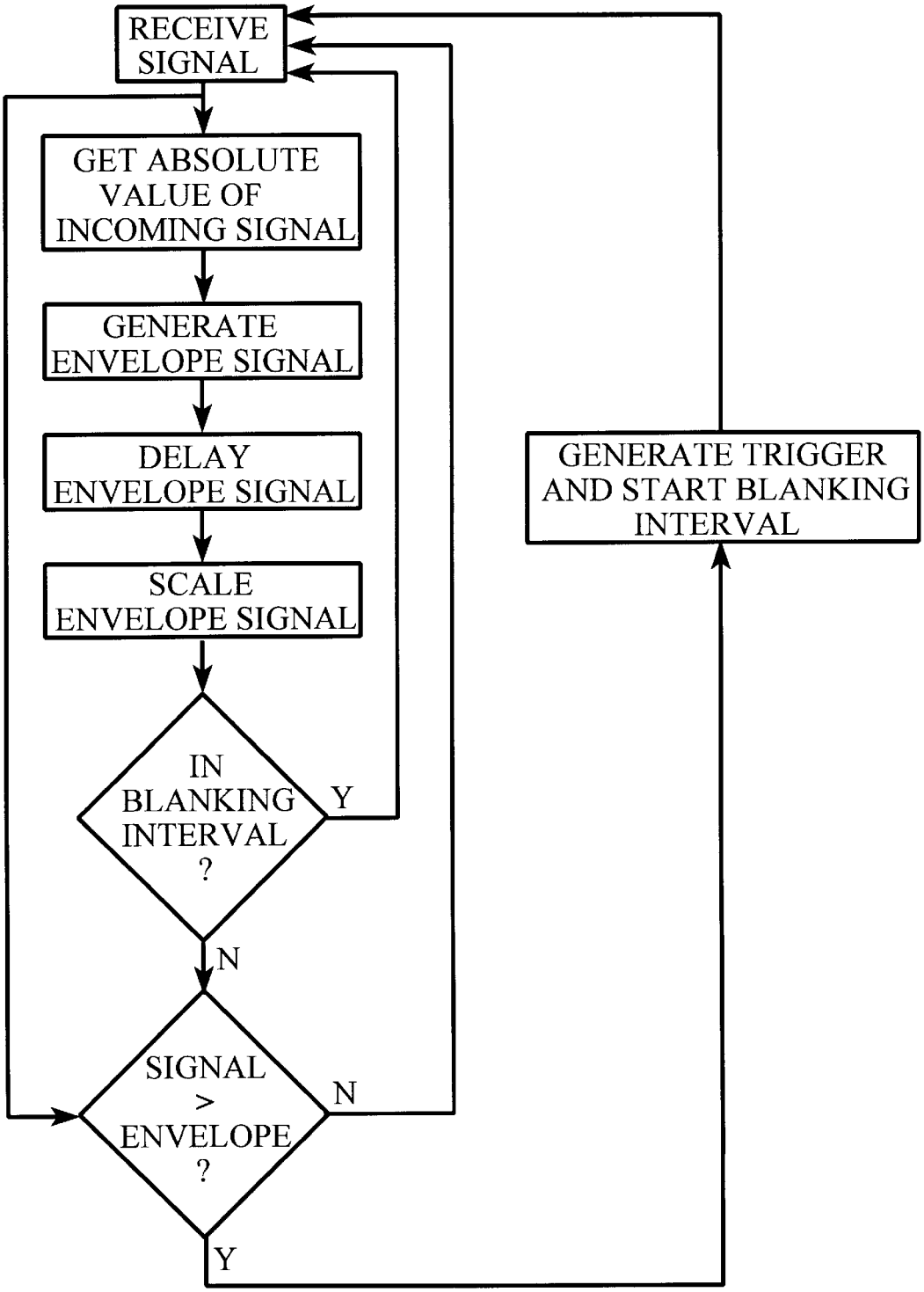
FIG. 4 is a flow diagram for the steps implemented by the attack transient detector.

FIG. 4 shows at representative flow diagram for the operations carried out by attack transient detector 10.

Figure 5:
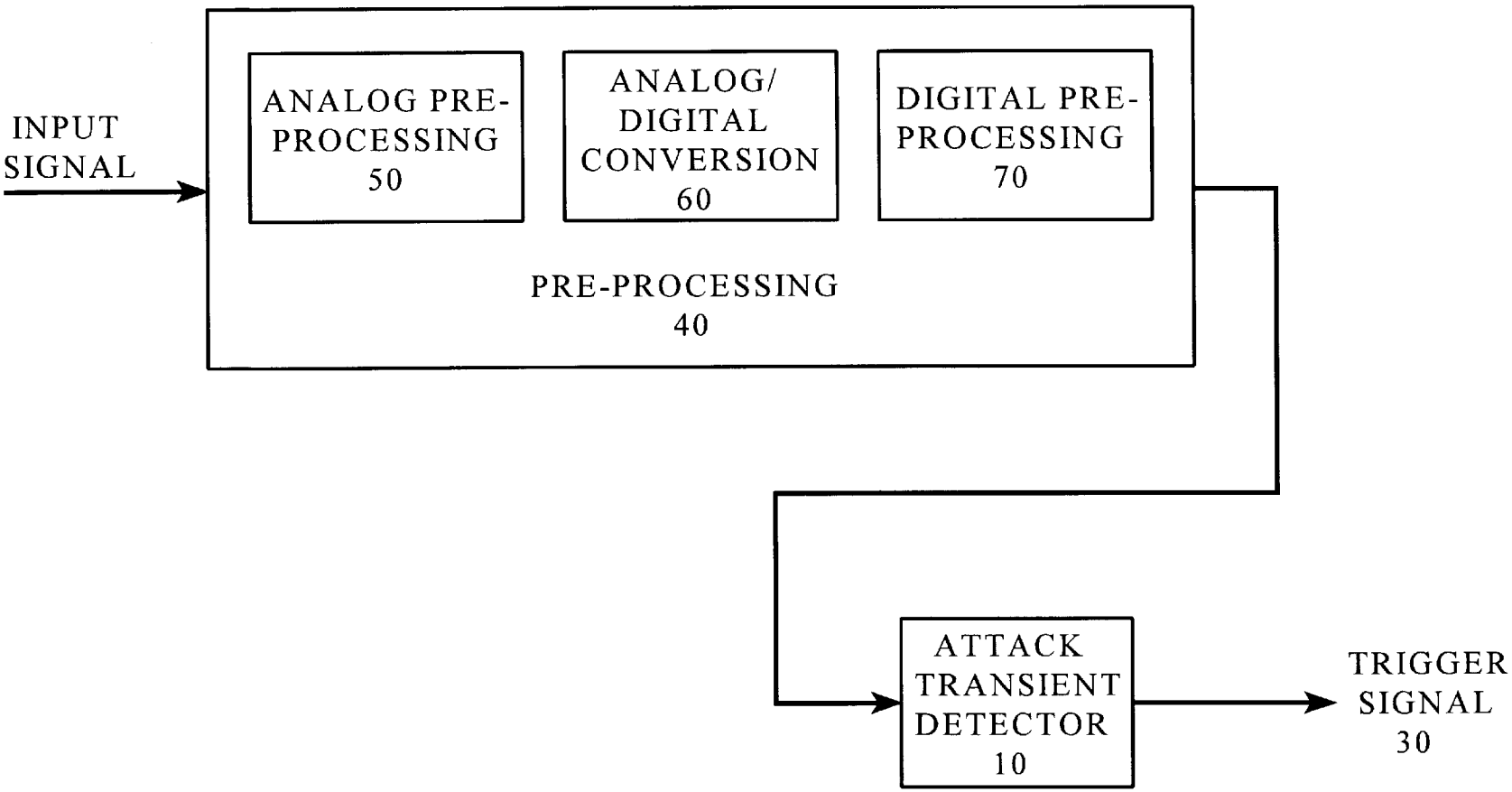
FIG. 5 is a block diagram of a second embodiment of the present invention.

Turning now to FIG. 5 a second embodiment of the present invention is shown where the signal from the musical instrument is subjected to pre-processing 40 before being passed on to attack transient detector 10. The pre-processing 40 can include operations such as signal compansion, analog/digital conversion, noise reduction, filtering, and/or deemphasis. As an example FIG. 5 shows analog pre-processing block 50, analog/digital converter block 60, and digital pre-processing block 70 within pre-processing block 40. In a preferred embodiment the signal from an electric guitar is first compressed then converted from analog to digital format before being passed on to attack transient detector 10.

In the first and second embodiments of the present invention signal processor 20 can be made to respond to trigger signal 30 in a variety of ways. For example; signal levels can be varied to produce pluck dependent volume swells/fades, tremolo effects or cross fades between different signals; in stereo applications signal panning can be varied according to the occurrence of trigger signal 30; and in the cease of other effects, such as chorus, reverb, flanging, pitch shifting and distortion, parameters for the effects, like speed or depth of modulation for chorus and flange or the amount of shift for pitch shifting, can be varied according to the occurrence of trigger signal 30. In a preferred embodiment the variation of parameters follows an ADSR (Attack, Decay, Sustain, and Release) format wherein, when the trigger signal occurs the parameter(s) being varied is/are:

1. changed to a starting value(s),
2. increased/decreased to an extreme value(s) over the attack time interval(s),
3. decreased/increased to a sustained value(s) over the decay time interval(s),
4. maintained at the sustain value(s) over the sustain time interval(s), and
5. decreased/increased to a final value(s) over the release time interval(s).

The ADSR format can be mapped to multiple parameters and can be user defined to include only portions of the format; e.g. attack-sustain or attack release; as is known in the art.

Figure 6:
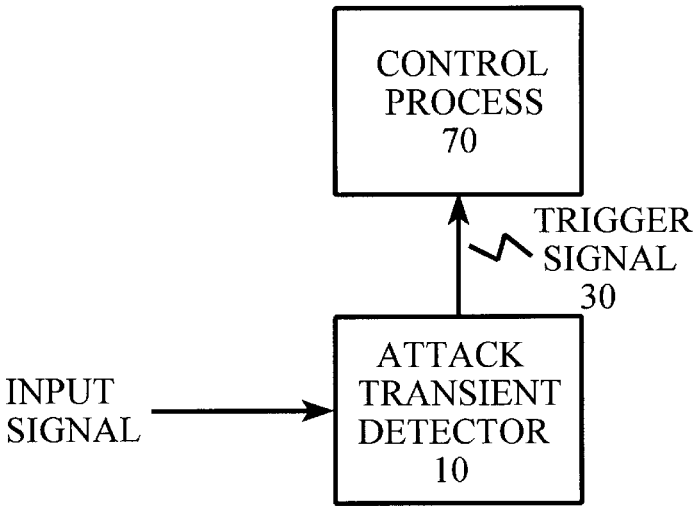
FIG. 6 is a block diagram of a third embodiment of the present invention.
Figure 7:
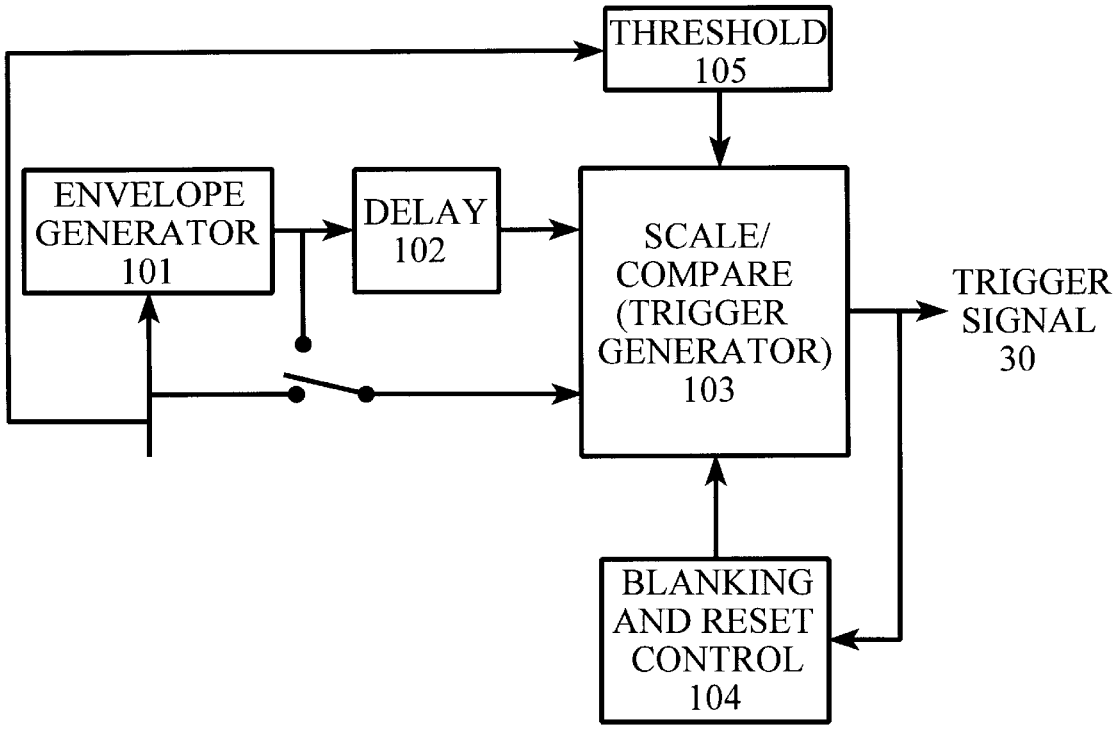
FIG. 7 shows a second embodiment of the present attack transient detector which is useful in the third embodiment of the present invention shown in FIG. 6.

FIG. 6 shows a third embodiment of the present invention wherein attack transient detector 10 generates a trigger signal 30 in response to the detection of the beginning of a note in the incoming musical instrument signal and trigger signal 30 feeds a control process 70; such as the activation/deactivation of stage lights or the display of different visual images on a screen; which does not operate on the signal from the musical instrument, thereby giving the musician control over non-audio events based on the moment of note occurrence. FIG. 7 shows a second embodiment of attack transient detector 10 which is useful in the third embodiment of the present invention. In FIG. 7 threshold unit 105 has been added to attack transient detector 10. Threshold unit 105 monitors the level of the incoming signal from the musical instrument and disables the generation of trigger signal 30 if the level is below a predetermined threshold value, thereby preventing the occurrence of false triggers, such as that shown in FIG. 3*e*, due to noise when there is little or no signal present. The reduction in false triggers helps ensure that control process 70 responds only to the occurrence of the beginning of a note played by the musician.

It will be apparent to those skilled in the art that many alternatives, modifications and variations may be made in the invention herein described without departing from the scope of the invention. All matters contained in this description or shown in the figures are illustrative and not a limitation of the scope of the invention. It is intended to encompass all such alternatives, modifications and variations as fall within the spirit of the appended claims.

What is claimed is:

1. An attack transient detector for a musical instrument signal comprising:

means for receiving an input signal from a musical instrument;

means for generating an envelope signal from said input signal;

means for delaying said envelope signal for a predetermined amount of time, with respect to said input signal, to form a delayed envelope signal;

means for generating a trigger signal in response to said input signal and said delayed envelope signal;

means for taking the absolute value of said input signal to obtain an absolute value signal, wherein said envelop signal is generated from said absolute value signal;

means for outputting, to said means for generating a trigger signal, said absolute value signal in place of said input signal.

2. The attack transient detector of claim 1 further comprising:

signal processing means for processing said input signal in response to said trigger signal.

3. The attack transient detector of claim 2, wherein said processing of said input signal by said signal processing means comprises:

dynamic modification of at least one processing parameter in response to said trigger signal.

4. The attack transient detector of claim 3 wherein said dynamic modification of at least one processing parameter comprises ADSR modification of said at least one processing parameter.

5. The attack transient detector of claim 4 further comprising:

control means, responsive to said trigger signal, for controlling non-audio events.

6. The attack transient detector of claim 1 further comprising:

threshold means for monitoring the level of said input signal and for inhibiting the generation of said trigger signal by said means for generating a trigger signal when said level is below a threshold value.

7. The attack transient detector of claim 1 further comprising:

means for pre-processing said input signal prior to passing said input signal to said attack transient detector.

8. The attack transient detector of claim 7 wherein:

said means for pre-processing said input signal includes analog and/or digital pre-processing of said input signal.

9. The attack transient detector of claim 1 further comprising:

signal processing means for processing said input signal in response to said trigger signal.

10. The attack transient detector of claim 9, wherein said processing of said input signal by said signal processing means comprises:

dynamic modification of at least one processing parameter in response to said trigger signal.

11. The attack transient detector of claim 10 wherein said dynamic modification of said at least one processing parameter comprises ADSR modification of said at least one processing parameter.

12. The attack transient detector of claim 11 further comprising:

control means, responsive to said trigger signal, for controlling non-audio events.

13. The attack transient detector of claim 9 further comprising:

threshold means for monitoring the level of said input signal and for inhibiting the generation of said trigger signal by said means for generating a trigger signal when said level is below a threshold value.

14. The attack transient detector of claim 9 further comprising:

means for pre-processing said input signal prior to passing said input signal to said attack transient detector.

15. The attack transient detector of claim 14 wherein:

said means for pre-processing said input signal includes analog and/or digital pre-processing of said input signal.

16. An attack transient detection system for a musical instrument signal comprising:

means for receiving an input signal from a musical instrument;

means for generating an envelope signal from said input signal;

means for delaying said envelope signal for a predetermined amount of time, with respect to said input signal, to form a delayed envelope signal;

means for generating a trigger signal in response to said input signal and said delayed envelope signal;

threshold means for monitoring the level of said input signal and for inhibiting the generation of said trigger signal by said means for generating a trigger signal when said level is below a threshold value;

signal processing means for processing said input signal in response to said trigger signal, wherein said processing of said input signal by said signal processing means comprises dynamic modification of at least one processing parameter in response to said trigger signal and wherein said dynamic modification of said at least one processing parameter comprises ADSR modification of said at least one processing parameter;

control means, responsive to said trigger signal, for controlling non-audio events; and means for pre-processing said input signal prior to passing said input signal to said attack transient detector, wherein said means for pre-processing said input signal includes analog and/or digital pre-processing of said input signal.

17. The attack transient detection system of claim 16, said means for generating an envelope signal further comprising:

means for taking the absolute value of said input signal to obtain an absolute value signal, wherein said envelope signal is generated from said absolute value signal; and means for outputting, to said means for generating a trigger signal, said absolute value signal in place of said input signal.

18. An attack transient detection system for a musical instrument signal comprising:

means for receiving an input signal from a musical instrument;

means for generating an envelope signal from said input signal;

means for delaying said envelope signal, with respect to said input signal, to form a delayed envelope signal;

means for generating a trigger signal in response to a comparison of said input signal and said delayed envelope signal;

means for inhibiting said means for generating a trigger signal for a predetermined amount of time after said trigger signal is generated, signal processing means for processing said input signal in response to said trigger signal; and control means, responsive to said trigger signal, for controlling non-audio events.

* * * * *